US005775414A

United States Patent [19]

Graham

[11] Patent Number: 5,775,414

[45] Date of Patent: Jul. 7, 1998

[54] HIGH TEMPERATURE HIGH PRESSURE AIR-TO-AIR HEAT EXCHANGERS AND ASSEMBLIES USEFUL THEREIN

[76] Inventor: Robert G. Graham, 6027 E. Grand Lake Rd., Presque Isle, Mich. 49777

[21] Appl. No.: 662,392

[22] Filed: Jun. 13, 1996

[51] Int. Cl.[6] ..... F28F 9/02

[52] U.S. Cl. ..... 165/158; 60/682; 165/905; 285/285.1; 285/295.1

[58] Field of Search ..... 165/158, 905; 285/285.1, 295.1, 915, 923; 60/682

[56] References Cited

U.S. PATENT DOCUMENTS

| | | |
|---|---|---|
| 1,429,149 | 9/1922 | Laurence . |
| 1,813,125 | 7/1931 | Robinson . |
| 1,974,402 | 9/1934 | Templeton . |
| 3,019,000 | 1/1962 | Bork . |
| 3,406,752 | 10/1968 | Lion . |
| 3,431,370 | 3/1969 | Crosby . |
| 3,675,710 | 7/1972 | Ristow . |
| 3,923,314 | 12/1975 | Lawler et al. . |
| 4,005,514 | 2/1977 | McClosky . |
| 4,018,209 | 4/1977 | Bonvicini . |
| 4,106,556 | 8/1978 | Heyn . |
| 4,122,894 | 10/1978 | Lauer . |
| 4,279,293 | 7/1981 | Koump . |
| 4,449,575 | 5/1984 | Lauer . |
| 4,632,181 | 12/1986 | Graham . |

FOREIGN PATENT DOCUMENTS

| | | |
|---|---|---|
| 191175 | 1/1923 | United Kingdom . |
| 2015145 | 9/1979 | United Kingdom . |

*Primary Examiner*—Noah P. Kamen
*Attorney, Agent, or Firm*—Robert L. McKellar

[57] ABSTRACT

What is disclosed herein is high pressure, high temperature, heat exchanger segments, combinations of such segments to form novel high pressure, high temperature, heat exchangers, novel pan assemblies for use in such heat exchangers, and systems and industrial processes utilizing such heat exchangers.

14 Claims, 5 Drawing Sheets

HIGH TEMPERATURE HIGH PRESSURE AIR-TO-AIR HEAT EXCHANGERS AND ASSEMBLIES USEFUL THEREIN

The invention disclosed and claimed herein deals with high temperature, high pressure air-to-air heat exchangers and certain new and novel assemblies useful therein.

In addition, there are disclosed heat exchanger segments, novel ceramic tube and pan assemblies, heat exchangers having a multi-pass configuration, and methods of utilizing such heat exchangers in processes to reduce the use of or eliminate standard steam boiler plants.

The heat exchangers of this invention are not standard heat exchangers, but are new and novel heat exchangers which have outstanding efficiencies in operation, among other valuable benefits.

In many industrial processes, the heat exchangers reduce the combustion products going out of the stack which means that from an environmental perspective there is less material being added to the air. In addition, the novel heat exchangers of this invention have the capability of being able to blow soot and melt slag off of the ceramic tubes. The heat exchangers of this invention have low or non-existent seal leakage, low or non-existent tube sheet-to-tube shell leakage and overall low leakage through the tube sheets and tubes due to the novel components of this invention.

The most promising market for the high temperature, high pressure devices is in the use of the same for indirect heating of clean air under pressure, which in turn is sent directly to a gas turbine. This totally eliminates the need for a boiler plant when generating electrical power. At the present time, there is not any practical way to generate electrical power using heavy oil or dirty oil, wood or trash/garbage as a fuel without cleaning the flue gas or without using a steam boiler. It is possible to drive a gas turbine using the flue gas directly from the combustion of a clean fuel, such as natural gas, however, this is the most expensive common fossil fuel available.

Industries and small municipalities should be able to burn heavy oil, plastic, paper, cardboard, wood and garbage, and other such materials, at the source of generation and in turn, produce electrical power that can be returned directly to a manufacturing process and/or put into an electrical grid. By this means, no boiler plant is required, and this eliminates the need for water treatment and the continuous operation of such boiler plants (boiler plants are very difficult to shut down and restart).

As opposed to the most recent designs of heat exchangers, the heat exchangers of the instant invention do not require, or do not use, tube sheet plugs and thus, the expense thereof is saved. All tube linear expansion is controlled at the shell extension so no ceramic slip expansion joints are required thereby reducing tube-to-tube sheet leakage.

Also, through the use of the novel slip joints near or in the central baffle, individual tubes can be replaced easily. The only disadvantage of the instant invention is that the tubes have to be replaced by entry into the heat exchanger.

BACKGROUND OF THE INVENTION

Ceramic or metal heat exchangers using indirect air-to-air technology are devices that extract thermal energy from high temperature flue gas and provide that thermal energy to a wide variety of diverse applications. The source from which the extraction is made is usually waste gas of some kind, such as hot waste fumes from an industrial furnace or the like.

In general, conventional shell and tube heat exchangers utilize a series of tubes supported at their ends by what is known in the art as tube sheets. Ambient air flows through, or is forced through the tubes, and a cross flow of hot gases, usually products of combustion-flue gases, are passed in a cross flow over the outside surface of the tubes to heat the air flowing through them.

Most of the known heat exchanger designs employ straight sided tubes which empty into plenums formed between the supporting tube sheets and the inner wall of the external housing or casing. The plenums are designed to carry the ambient air to other zones in the internal heat exchanger construction employing another set of tubes for passing the air back through the central chamber through which the heated waste fumes flow. Thus, heat exchangers are normally stacked or otherwise fastened together to increase the operating flow length of both the ambient air and the waste gas and the flow of the ambient air between the plenums and tubes creates a pressure loss within the system. These pressure losses must be overcome by an increase in the horsepower of the fans for moving the ambient air in order to maintain a given velocity of the ambient air flow. These pressure losses also make it difficult to operate at higher pressures, and consequently, the heat exchangers of the prior art are not operated at the high pressures, or if attempts are made to do so, there is severe leakage. These pressure losses also make it difficult to maintain an air tight seal from the ambient air side to the gas side subsystem. The resultant leakage which may occur not only decreases the flow of the ambient air, but also allows air to flow into the fumes to reduce overall heat transfer efficiency. Also, there is an acute operating temperature loss in the heat exchanger with this type of arrangement. Air side temperatures at operation of the prior art heat exchangers range from about 800° F. to about 1200° F., while the temperatures permitted by the use of the heat exchanger of the instant invention can range from 800° F. to about 2400° F. Further, the clean air side pressures at operation of the prior art ceramic heat exchangers range from 0.25 psig to 2 psig, while the pressures permitted by the use of the heat exchanger of the instant invention can range from slightly above zero psig to 250 psig. Therefore, for purposes of this invention, what is meant by "high pressure", are pressures in the range of slightly above zero psig to 250 psig, and what is meant by air side "high temperatures" are temperatures in the range of 1200° F. to about 2400° F.

One of the most egregious forms of inefficiency in heat exchangers occurs in the connections of the tubes to the tube sheets, wherein leakage is usually of a high volume. In addition, the tube sheet itself is subject to expansion and when it expands, it expands in an uncontrolled manner which causes the tube sheet to move out of alignment, and thus cause more leakage.

Many of the advantages and benefits of the instant invention are due to, but not limited to, the use of nitride-bonded silicon carbide dome bricks; checker style nitride-bonded silicon carbide special bricks; high alumina refractory skewbacks; high density, low porosity ceramic coatings on the pan seals of the heat exchanger; novel pan seal socket assemblies; tube-to-tube connecting sleeves on the ceramic tubes used therein; and, external compression spring-loaded tube expansion allowance devices, all of which will be described in detail infra.

Means of overcoming some of these prior art problems have been set forth and discussed in a copending patent application in the name of the inventor herein which is entitled "Low to Medium Pressure High Temperature All- Ceramic Air-to-Air Indirect Heat Exchangers With Novel Ball Joints and Assemblies", having U.S. Ser. No. 08/548 575, filed on Oct. 26, 1995, and another copending patent application in the name of the inventor herein which is entitled "Heat Exchangers With Novel Ball Joints and Assemblies And Processes Using Such Heat Exchangers", having U.S. Ser. No. 08/625 569, filed on Mar. 28, 1996.

The heat exchangers of the prior art that are subject to many of the problems set forth above can be found in one or more of the following patents: UK 191 175, published Jan. 11, 1923; UK 2 015 146, published Sep. 5, 1979; U.S. Pat. No. 1,429,149, issued on Sep. 12, 1922 to Lawrence; U.S. Pat. No. 1,813,125, issued on Jul. 7, 1931 to Robinson; U.S. Pat. No. 1,974,402, issued on Sep. 18, 1934 to Templeton; U.S. Pat. No. 3,019,000, issued on Jan. 30, 1962 to Bork; U.S. Pat. No. 3,406,752, issued on Oct. 22, 1968 to Lion; U.S. Pat. No. 3,431,370, issued on Mar. 4, 1969 to Crosby; U.S. Pat. No. 3,675,710, issued on Jul. 11, 1972 to Ristow; U.S. Pat. No. 3,923,314, issued Dec. 2, 1975 to Lawler et al.; U.S. Pat. No. 4,005,514, issued on Feb. 1, 1977 to McCloskey; U.S. Pat. No. 4,018,209, issued on Apr. 19, 1977 to Bonvicini; U.S. Pat. No. 4,106,556, issued on Aug. 15, 1978 to Heyn; U.S. Pat. No. 4,122,894, issued on Oct. 31, 1978 to Laws; U.S. Pat. No. 4,279,293, issued on Jul. 21, 1981 to Koump; U.S. Pat. No. 4,449,575, issued on May 22, 1984 to Laws, and U.S. Pat. No. 4,632,181, issued on Dec. 30, 1986 to Graham.

THE INVENTION

The invention disclosed and claimed herein deals with high pressure, high temperature, heat exchanger segments, combinations of such segments to form novel high pressure, high temperature, heat exchangers, novel pan assemblies for use in such heat exchangers, and systems and industrial processes utilizing such heat exchangers.

More specifically, this invention deals in one embodiment with a novel high pressure, high temperature, heat exchanger sprung dome segment comprising (I) a multiple-layered air entry or exit assembly wherein (a) is a first layer which is a nitride-bonded air entry or exit, silicon carbide, brick array, having an air entry or exit surface and a base and an air entry or exit end. The base has essentially a circular configuration and the air entry or exit surface is coated with a dense, low porosity ceramic coating.

The array has a plurality of openings extending from the air entry or exit surface through the base, and the base has a plurality of pan openings therein, each pan opening essentially in alignment with each of the openings in the array.

The first, or outer brick layer has a plurality of holes in it and a back surface. There is a second outer brick layer which has a plurality of slots in it and it has a back surface, wherein the slots and holes are filled with light-weight, insulating castable alumina refractories. Finally, in the multiple-layered air entry or exit assembly there is a third outer layer which is configured from mullite refractory and has a back surface.

Another component is (b), a two-layered outer dome having a large center opening through it wherein the outer dome has an inside layer and an outside layer. The inside layer is a high temperature type castable insulation and the outside layer has an outside surface and is a low temperature type castable insulation. Both layers have essentially aligned back surfaces.

Yet another component is (c), a first steel shell, said steel shell having a distal end and a near end. The first steel shell covers essentially the entire outside surface of the two-layered outer dome and conforms essentially to the outside surface of the outside layer of the brick layers. The first steel shell has a steel plate fixedly attached to and covering the distal end of the first steel shell wherein the steel plate has a large centered opening through it to allow the passage of air into the two-layered outer dome. The steel shell is designed to meet applicable ASTM fired pressure vessel codes.

There is still another component, (d), which is a dual-walled steel flange encircling the heat exchanger at the line formed by the near end of the steel shell. The steel flange has a front surface and a back surface, and the dual-walled steel flange has an inside edge and an outside edge. The steel flange is fixed to the near end of the steel shell and at the inside edge.

Another component is (e), a flat steel bar fixed to the first steel flange front surface and fixed to the outside surface of the first steel shell near the near end thereof to form a brace between the first steel flange and the first steel shell.

Component (f) is a high alloy metal flashing fixed to the inside surface of the first steel shell and near the near end of the first steel shell, wherein the high alloy metal flashing has a distal edge and the high alloy metal flashing covers the aligned back surfaces of the two-layered outer dome layers and has the distal edge thereof inserted between the first outer brick layer and the second outer brick layer thereof.

Part (II) of the heat exchanger segment is a multi-layered central body, said central body having essentially a round configuration wherein there is a first insulating fire brick lining having an outside surface, a second insulating fire brick layer having an outside surface and conforming essentially to the outside surface of the first insulating fire brick layer, and a third insulating fire brick layer having an outside surface and conforming essentially to the outer surface of the second insulating fire brick layer.

There is a second steel shell having an outside surface covering and conforming essentially to the outside surface of the third insulating fire brick layer of Part (II), said second steel shell having a near edge and a distal edge. The second steel shell has a dual-walled second steel flange encircling the heat exchanger segment at the line formed by the near end of the second steel shell, wherein the second steel flange has an inside edge and an outside edge and the second steel flange is fixed to the near end of the second steel shell and at the inside edge.

The first steel flange and the second steel flange are fixed together near their respective outside edges by a flat steel cover having an inside surface such that the flat steel cover, the first steel flange, the second steel flange and the third outer layer of the air entry or exit assembly form a tunnel encircling the heat exchanger segment to form a "skew-back". The skewback transmits the forces from the air pressure through the dome to the reinforced support steel shell.

The inside surface of the steel cover is covered with a thin layer of ceramic fiber matting and the tunnel is filled with mullite refractory.

The back surfaces of the first fire brick lining , the second insulating fire brick layer and the third insulating fire brick layer are layered with a ceramic fiberboard. The fiberboard has a back surface and there is a ceramic fiber matting layered against that back surface over the area opposite the third outer layer of mullite refractory. The ceramic fiber matting is configured such that it also covers any exposed mullite refractory in the tunnel.

There is a second flat steel bar fixed to the second steel flange back surface and fixed to the outside surface of the second steel shell near the near edge thereof to form a second brace between the second steel flange and the second steel shell.

In addition, there is a flue gas port for entry or exit of flue gas, said port being configured such that entry or exit of flue gas to the heat exchanger segment is essentially perpendicular to the flow of air through the heat exchanger segment ceramic tubes, said port being configured such that it is a round configuration. It is formed from a first insulating fire brick lining having an outside surface, a second insulating fire brick layer having an outside surface and conforming essentially to the outside surface of the first insulating fire brick layer, and a third insulating fire brick layer having an outside surface and conforming essentially to the second insulating fire brick layer, all such layers being contiguous and essentially continuous with the like layers in the dome.

There is a third steel shell, said steel shell having a distal end and a near end, said third steel shell covering essentially the entire outside surface of the flue gas port and conforming essentially to the outside surface of the third insulating fire brick layer. The third steel shell has a second steel plate fixedly attached to and covering the distal end of the third steel shell and the second steel plate has a large centered opening through it to allow the passage of flue gas into the central body.

The second steel shell has fixed on and encircling the outside surface near the distal end thereof, an L-shaped steel bar having a vertical wall and a horizontal wall. The vertical wall has a plurality of openings essentially centered through it.

The second steel shell has fixed on its inside surface near the distal end thereof, a flat metal plate, which flat metal plate conforms to the inside of the second steel sheet.

There is a plurality of ceramic tubes having near ends and distal ends. Each ceramic tube is aligned at its near end and inserted in a pan opening in the silicon brick array. The ceramic tubes are supported on their distal ends by a central baffle wall.

There is yet another embodiment in this invention which is a high temperature high pressure air-to-air heat exchanger comprising in combination two heat exchanger segments as described above, aligned at their respective ends such that the ceramic tubes contained in each of them align at the ceramic tube distal ends and are supported by a common central baffle wall.

There is a plurality of metal springs affixed to the inside surfaces of the L-shaped steel bars essentially at the intersection of the vertical and horizontal walls, and a plurality of fasteners spaced along the L-shaped steel bars, and in alignment with the respective holes centered in the vertical walls. The fasteners fasten and hold the heat exchanger segments to each other.

The second flat metal plate conforms to the inside of one of the second steel sheets but is not fixed to said steel sheet on one of its edges.

In this configuration, all abutting insulation fire brick surfaces have a crushable ceramic fiber between them.

Yet another embodiment of this invention is a pan assembly for use in the above-described heat exchanger. The novel pan assembly comprises in combination, a component (A), which is a nitride-bonded, silicon carbide, brick array, having an air entry or exit surface and a base having a back surface.

The array has a plurality of pan openings extending from the air entry or exit surface through the back surface of the base, the pan openings having an inside surface.

Each pan opening has a circular housing with an outside surface and the housing is mortared at its outside surface to the inside surface of the pan opening. The housing has a center axis, a front opening, and a back opening, wherein the front opening and back opening have a common center axis with the housing center axis. The front opening in the housing is commensurate in size to the openings in the array, the back opening being larger than the front opening. There is in addition, a crushable, friable ceramic fiber centering ring interfacing with the inside surface of the housing.

The other component, (B), is a ceramic tube having mortared on one end thereof a ceramic collar. The collar has a front surface and a front opening and a back opening and the front opening has a size smaller than the opening of the circular housing. The back opening is larger than the front opening and is enabled to receive a ceramic tube end. The interface between the ceramic tube end and the inside of the back opening of the ceramic collar is mortared and the front surface has a circular channel in it and the channel contains a seal ring.

Finally, there is disclosed an industrial system in which the heat exchangers described supra, are used. The industrial system is an improved system for generating electrical energy from combustible waste, the system comprising in combination at least: (A) a high pressure clean air supply; (B) at least one alloy metal heat exchanger; (C) a combustible waste delivery means; (D) a combustion chamber for the combustible waste; (E) an expansion turbine; (F) an electrical generator; (G) an acid neutralizing scrubber, and (H) at least one high temperature ceramic heat exchanger as disclosed herein.

DETAILED DESCRIPTION OF THE DRAWINGS

Figure 1:
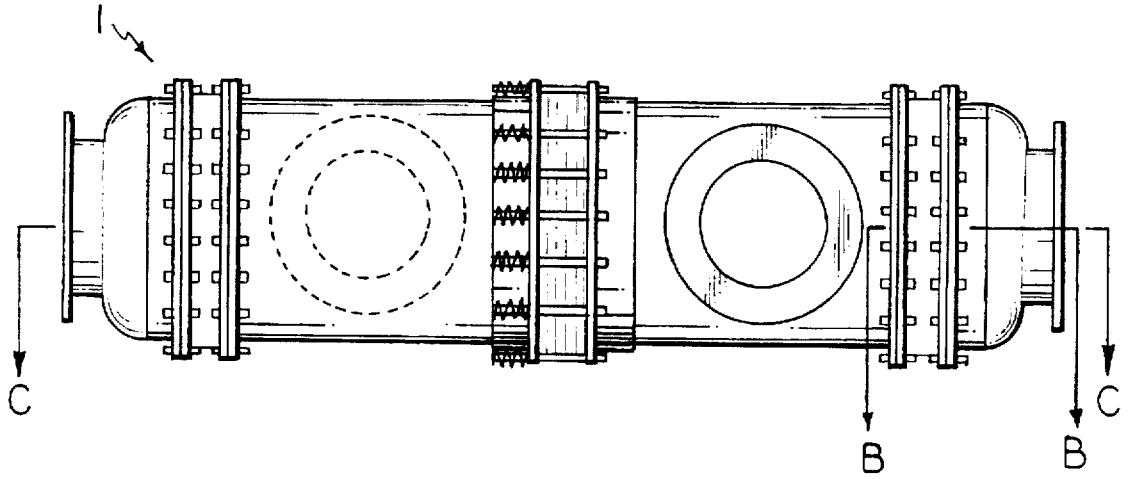
FIG. 1 is a full side view of a heat exchanger of this invention.

Turning now to the Figures, and with regard to FIG. 1 there is shown a full side view of a heat exchanger 1 of this invention.

Figure 3:
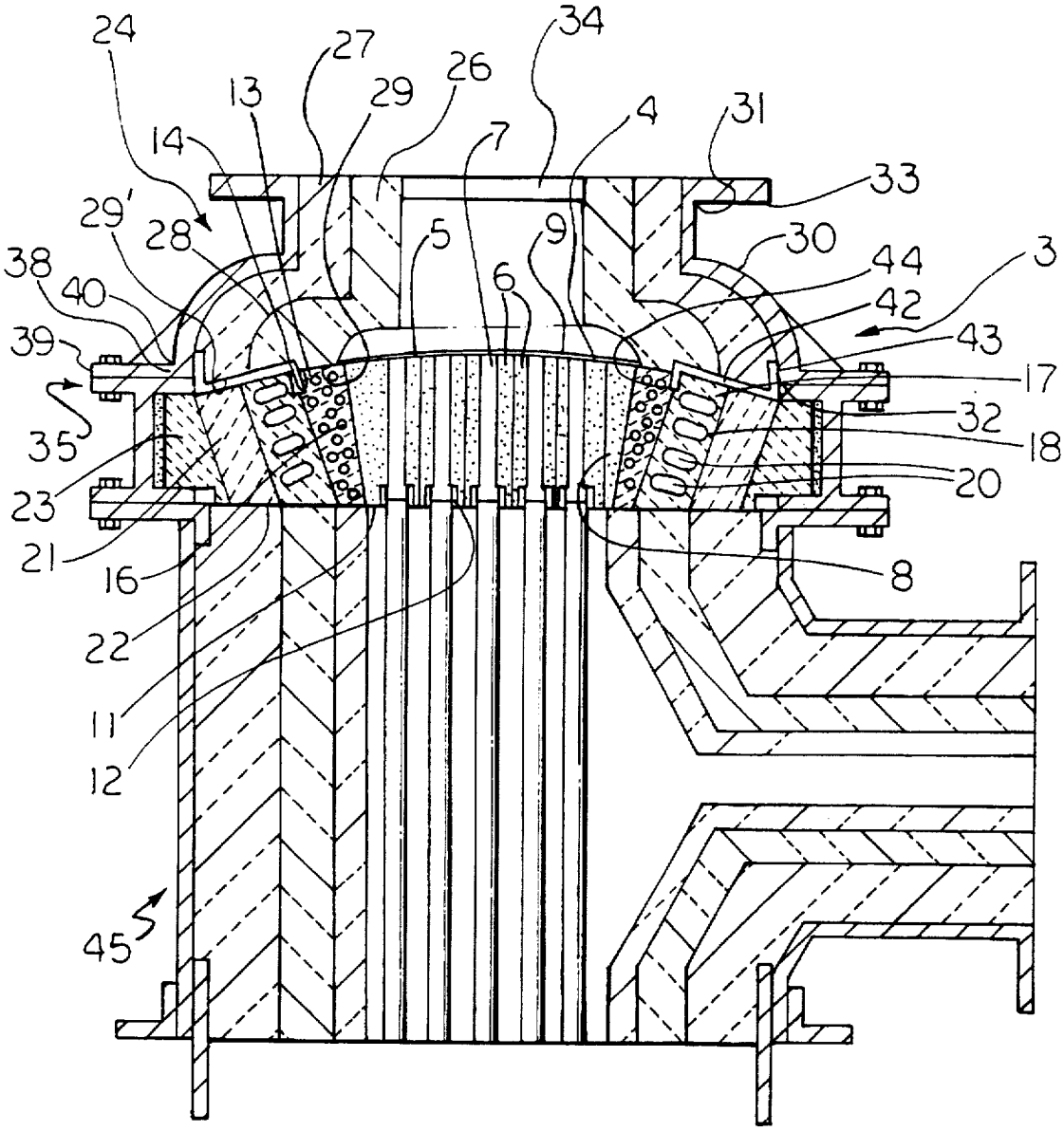
FIG. 3 is a cross-sectional view through line A—A of FIG. 1 and shows a heat exchanger segment of this invention.
Figure 4:
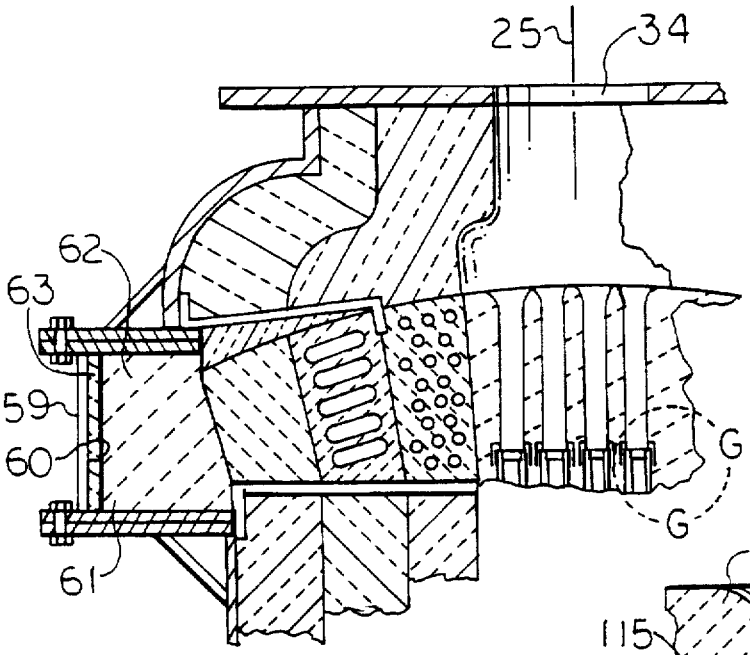
FIG. 4 is an enlarged, partial cross-sectional view of a portion of FIG. 1, indicated by line B—B.

With regard to FIGS. 3 and 4, there is shown in FIG. 3 a heat exchanger segment 2 of this invention in which there is further shown (I), a multiple component, multiple-layered air entry or exit assembly 3 which comprises (a), a first layer, which is a nitride-bonded silicon carbide circular brick array 4 having an air entry or exit surface 5 and a essentially flat circular base 8. The silicon carbide brick array 4 is made up of silicon carbide bricks 6, each of the bricks having channeled openings 7 throughout their length and extending through the base 8. These bricks 6 are rammed, silicon carbide ceramic shapes, and when manufactured, they each have one-half of the channeled opening 7 formed therein, such that when they are mortared together in the array 4, the one-half channeled openings form the channelled opening 7. This silicon carbide material, as opposed to high alumina refractory, is used because it gets stronger as the temperature of the heat exchanger increases during its operation.

Figure 8:
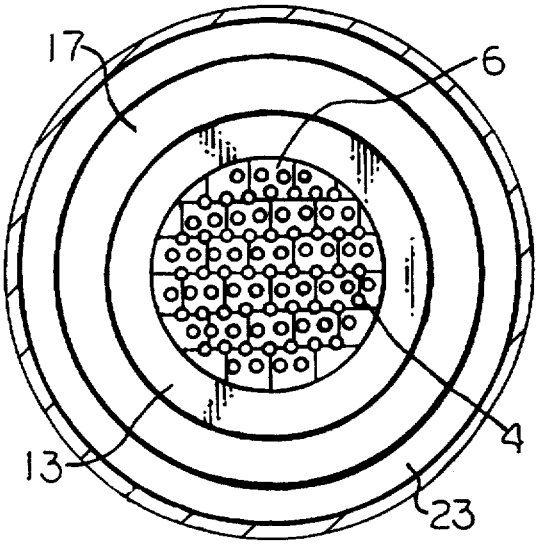
FIG. 8 is an a cross-sectional of the brick array and three layers of brick insulation taken through line G of FIG. 2.

It is true that silicon carbide has a high K-factor and is thus favored for this use, however, this high K-factor can also be a disadvantage, in that, a tube sheet manufactured from this material can transfer considerable heat to the steel shell covering the heat exchanger. However, the inventor herein has addressed that problem, and others, and has solved them as will become ascertainable from the discussion infra. A further observation of FIG. 8, which is a cross-sectional view of the brick array and insulating layers described above, is shown. The view is taken through line G of FIG. 2 and shows the brick array 4, the individual bricks 6, the first insulating brick layer 13, the second insulating brick layer 17, and the third insulating brick layer 23.

For purposes of this invention, the air entry or exit surface 5 is entirely coated with a dense, low porosity ceramic coating 9. This coating 9 is coated such that it goes over the joints 10 between the brick and down into the channeled openings 7. This coating 9 has the same expansion characteristics as the silicon carbide and thus the expansion and contraction rates of the coating 9 and the brick 6 are the same during operation of the heat exchanger.

The base 8 has a back surface 11, in which are located pan openings 12. The pan openings 12 are larger in diameter than the channeled openings 7, and are intended to receive a portion of a pan assembly 118, which will be discussed infra. Each of the pan openings 12 are essentially axially aligned with each of channeled openings 7 of the array 4.

With regard to the multi-layered air entry or exit assembly, there is a first outer brick layer 13 having a plurality of holes 14 therethrough and this layer 13 has a back surface 15. The holes 14 are filled with a light-weight, insulating castable alumina 16, the purpose being to retain the strength of the layer 13 to transmit the thrust from the dome through the brick to the steel shell, while reducing the weight and the K-factor of the silicon carbide, and thus reducing the amount of heat that reaches the steel shell of the heat exchanger 1.

In addition, there is a second outer brick layer 17 which has a plurality of slots 18 therein and a back surface 19. As in the layer 13, the slots 18 are filled with a light-weight, insulating castable alumina 20 for the same reasons. Thus, both the first outer brick layer 13 and the second outer layer 17 result in a structurally strong silicon carbide shape that has some insulating properties.

In addition, in this multi-layered component, there is a third layer 21, which is configured from mullite. This layer also has a back surface 22, and finally, there is a fourth layer 23, which will be discussed infra with regard to the tunnel.

Component (b) of (I) is a two-layered outer dome 24, having a large center opening 25 through it. The outer dome 24 has an inside layer 26, an outside layer 27, and the inside layer 26 is manufactured out of high temperature type castable insulation. The outside layer 27 has an outside surface 28 and is made up of low temperature type castable insulation. Both layers 26 and 27 have essentially aligned back surfaces 29 and 29'.

There is a first steel shell 30 which has a distal end 31 and a near end 32. The first steel shell 30 covers essentially the entire outside surface 28 of the dome 24 and conforms essentially to the outside surface 28. The first steel shell 30 has a steel plate 33 fixedly attached to and covering the distal end 31. The steel plate 33 has a large central opening 34.

There is a dual-walled steel flange 35 encircling the heat exchanger 1, at the line 40 formed by the near end 32 of the steel shell 30. The steel flange 35 has a back surface 36 and a front surface 37 and the steel flange also has an inside edge 38 and outside edge 39, the steel flange 35 being fixed to the near end 32 of the steel shell 30 at the inside edge 38 by welding or the like.

There is a flat steel bar 41 fixed to the first steel flange front surface 37 and also fixed to the outside surface of the first steel shell 30 which flat steel bar 41 encircles the dome 24 and provides a brace for the components.

There is provided a high alloy metal flashing 42 which is fixed to the inside surface of the first steel shell 30 at point 43 and near the near end 32 of the first steel shell 30. The high alloy metal flashing 42 has a distal edge 44, and the high alloy metal flashing 42 covers the aligned back surfaces 29 and 29' of layers 26 and 27. The distal edge 44 of the high alloy metal flashing 42 is inserted between the first outer brick layer 13 and the second outer brick layer 17 to secure it in place. This is carried out during construction of the heat exchanger 1. This high alloy, light-gauge steel flashing is full-seam welded to the first steel shell 30. Pressure vessels, and heat exchangers in particular contain refractory linings having a tendency to channel the hot gases through joints and cracks, especially as they age. The metal high alloy metal flashing of this invention takes the high temperatures and high pressures and directs any channeling from the clean air, hot gas side, to the furnace side, where contamination has no impact.

Component (II) of the heat exchanger segment 2 is a multi-layered central body 45 and it has essentially a round configuration wherein there is a first insulating fire brick lining 46 having an outside surface 47, a second insulating fire brick layer 48 having an outside surface 49, which conforms essentially to the outside surface 47, and a third insulating fire brick layer 50, also having an outside surface 51. This layer 50 conforms essentially to the outer surface 49 of the second insulating fire brick layer 48.

Covering this multi-layered component is a second steel shell 52 which has an outside surface 53. This second steel shell 52 covers and essentially conforms to the outside surface of the third insulating firebrick layer 50. The second steel shell 52 has a near end 54 and a distal end 55.

The second steel shell 52 has a dual-walled second steel flange 56 encircling the heat exchanger segment 2 at the line 57 formed by the near end 54 of the second steel shell 52. The second steel flange 56 has an inside edge 58 and an outside edge 59. The second steel flange 52 is fixed to the near end 54 of the second steel shell 52 and at the inside edge 58 thereof.

The first steel flange 35 and the second steel flange 56 are fixed together near their respective outside edges by a flat steel cover 59 having an inside surface 60 such that the flat steel cover 59, the first steel flange 35, the second steel flange 56 and the third outer layer of the air entry or exit assembly 3 form a tunnel 61 encircling the heat exchanger segment 2. This arrangement is known in the art as a "skewback" assembly and is common in the industry. The tunnel 61 is filled with a dense, high alumina refractory 62 in order to provide thermal insulation at this point of the apparatus. Since the temperature near the shell is low, the high alumina material will not deform and the K-factor is one-tenth that of the silicon carbide internal to the heat exchanger.

The inside surface 60 of the flat steel cover 59 is covered with a crushable ceramic fiber 63. During operation, the dome 24 will expand in circumference as the temperature increases. A tight seal is maintained between the skewback and the flanges, and the insulation 63 crushes to help absorb the expansion.

The back surfaces 29 and 29' of the first fire brick lining 46, the second insulating fire brick layer 48, and the third insulating fire brick layer 50 are layered with a ceramic fiberboard 64. The ceramic fiberboard 64 has a back surface 65 and the back surface 65 has a ceramic fiber matting 66 layered against it, essentially over the area opposite the third outer layer of mullite 21. The ceramic fiber matting 65 is configured such that it also covers any exposed alumina filler 62 in the tunnel 61.

There is a second flat steel bar 67 fixed to the second steel flange 56, on the back surface there of and the second flat steel bar 67 is also fixed to the outside surface 53 of the second steel shell 52 near the near edge 54 to form a second brace 68 between the second steel flange 56 and the second steel shell 52.

Perpendicular to the entry assembly 3, and extending out from the wall of the central body 45 is a flue gas port 69 for entry or exit of flue gas. The flue port 69 is configured such that entry or exit of flue gas to the heat exchanger segment 2 is essentially perpendicular to the flow of the air through the heat exchanger segment 2. The port 69 is configured such that it is a round configuration wherein there is a first insulating fire brick lining 70 which is essentially equivalent to the first insulating brick lining 46 of the central body 45. This first insulating fire brick lining 70 has an outside surface 71. Likewise, there is a second insulating firebrick layer 72 having an outside surface 73, which second insulating firebrick layer 72 conforms essentially to the outside surface 71 of the first insulating fire brick layer 70. Still further, there is a third insulating fire brick layer 74 having an outside surface 75, which conforms essentially to the second insulating fire brick surface 73.

Overlaying this assembly of insulating brick, is yet a third steel shell 76. The third steel shell 76 has a distal end 77 and a second steel plate 78 fixed attached to and covering the distal end 77 of the third steel shell 76. The second steel plate 78 has a large centered opening 79 through it to allow the passage of flue gas into or out of the central body.

The second steel shell 52 has fixed on, and encircling the outside surface 53 thereof, near the distal end 55, an L-shaped steel bar 80 which has a vertical wall 81 and a horizontal wall 82. The vertical wall 81 has an opening 83 centered through it for the accommodation of a fastener 84. Also, the second steel shell 52 has fixed on its inside surface 58, near the distal end 55 thereof, a flat metal plate 85, which flat metal plate 85 conforms to the inside of the second steel shell 52.

In addition, the heat exchanger segment 2 contains a plurality of ceramic tubes 86 which have near ends 87 and distal ends 88. Each ceramic tube 86 is aligned at its near end 87 and inserted in a pan opening 12 in the silicon carbide brick array 4. The distal ends 88 of the ceramic tubes 86 are supported by a central baffle wall 89, shown in FIG. 2.

Figure 2:
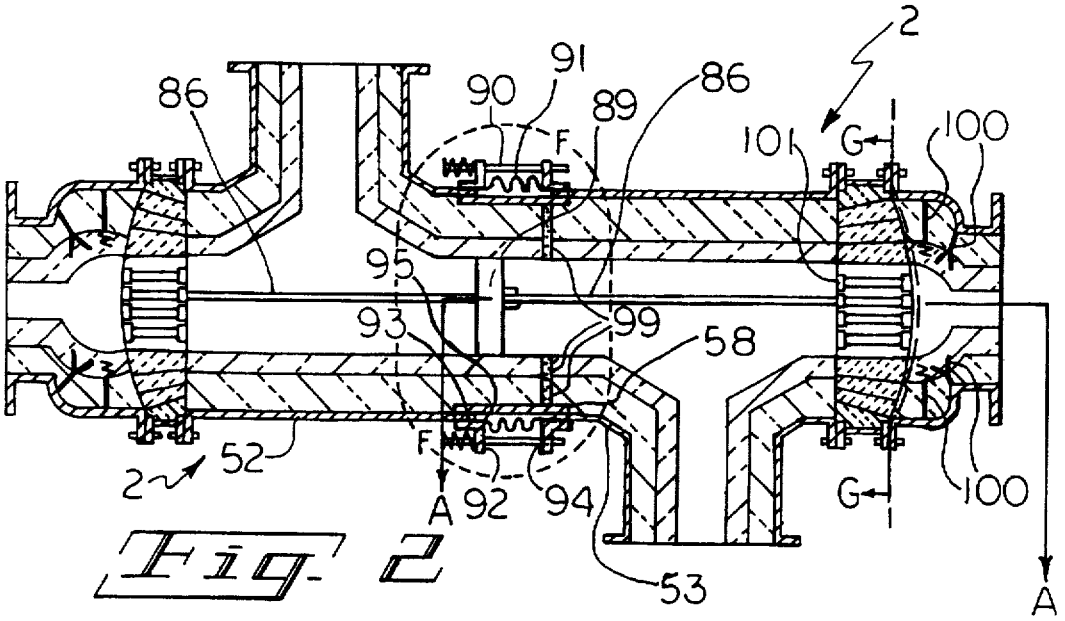
FIG. 2 is a full cross-sectional view of a heat exchanger of this invention taken through line C—C of FIG. 1.
Figure 6:
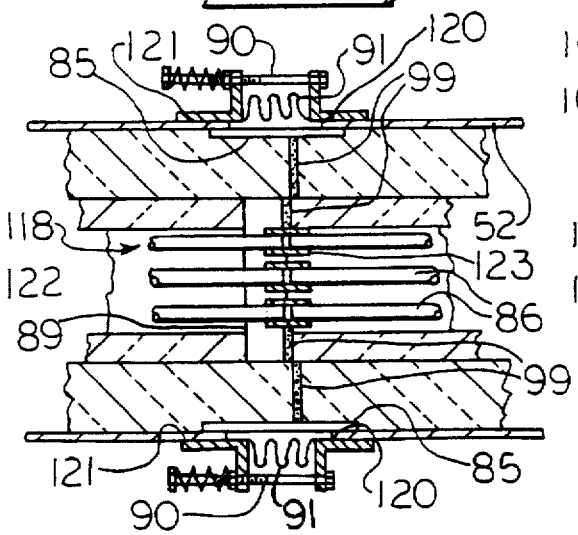
FIG. 6 is an enlarged top view of the area designated by F on FIG. 2.

Also shown in FIG. 2 is a full cross-sectional top view of a high temperature, high pressure,air-to-air heat exchanger 1 comprising in combination, (I) two heat exchanger segments 2 as just described supra, which are aligned at their respective ends such that the ceramic tubes 86 contained in each of them align at the ceramic tube distal ends 88 and are supported by a common baffle wall 89 (further detail is also provided by FIG. 6).

The entire steel shell 52 is surrounded with a pair of L-shaped angle frames 80 which have a plurality of connecting fasteners 90 that are spring loaded on the outside of the L-shaped bars and on the fasteners with compressible springs 124. Each end of the fasteners 90 have an adjusting means 126, which for example can be a simple nut which screws on the threaded fasteners and compresses the spring 124 on one side of the angle frames 80 The angle frames 80 have a vertical wall 92 and a horizontal wall 93 and the horizontal wall 93 is welded or otherwise fixed to the outside surface 53 of the second steel shell 52. The vertical wall 92 has a plurality of openings 94 through it (shown in phantom in FIG. 2) to accommodate the plurality of connecting fasteners 90. The bellows expansion joints 125 have each of their ends 95 securely fastened to the respective vertical walls 92 at the point that the horizontal walls 93 are fastened to the outside surface 53 of the second steel sheet 52 and essentially at the point that the fasteners 90 are located on the L-shaped angle frames 80, and after the heat exchanger 1 is lined and assembled, the tubes-to-tube-sheets and tubes-to-tube fasteners are all torqued lightly to hold the springs 124 in slight compression (additional detail is shown in FIG. 6).

When the air side temperature is heated to about operating temperature, and the heat exchanger 1 is still at or near atmospheric pressure, the apparatus is checked for leakage. As the heat exchanger 1 is brought up to temperature, the air is preheated to a maximum of about 2000° F. and the ceramic tubes 86 expand on average about ½" to ¾ inches in length. This expansion will be taken up by the springs 124 at the steel shell periphery.

As shown in FIG. 2, there is shown at 58, the inside edge of the second steel flange 56. Fixed to the inside edge 58 at point 120, is the flat steel plate 85, whose opposite edge 97, at point 121, is not fixed to the steel shell 52, but is left to slide matingly with the inside surface of the steel shell 52. This device allows the central bodies of each of the heat exchanger segments 2 to move essentially along the line of the center axis 98 of the heat exchanger 1, as shown by line D—D on FIG. 2, the fasteners 90 of course, stopping the segments 2 from completely separating from each other. At the interface of where the respective fire brick linings of each of the heat exchanger segments 2 meet during this operation, there is located ceramic fiber matting gaskets 99 to help absorb the compression of the fire bricks on each other. This is shown in FIG. 2, and in detail in FIG. 6. For purposes of clarification, there is shown only one ceramic tube 86 in FIG. 2.

In certain configurations of the heat exchanger 1, there can be used metal alloy anchors 100 as are shown in FIG. 2. These anchors are placed in the layers 26 and 27 as they are being formed during construction of the heat exchanger 1.

Figure 5:
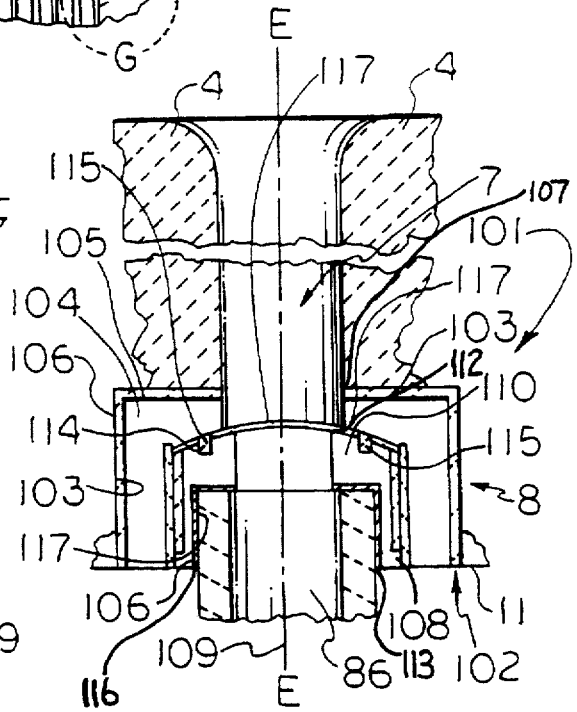
FIG. 5 is an enlarged view of a pan seal assembly in cross-sectional taken from area G of FIG. 4.
Figure 7:
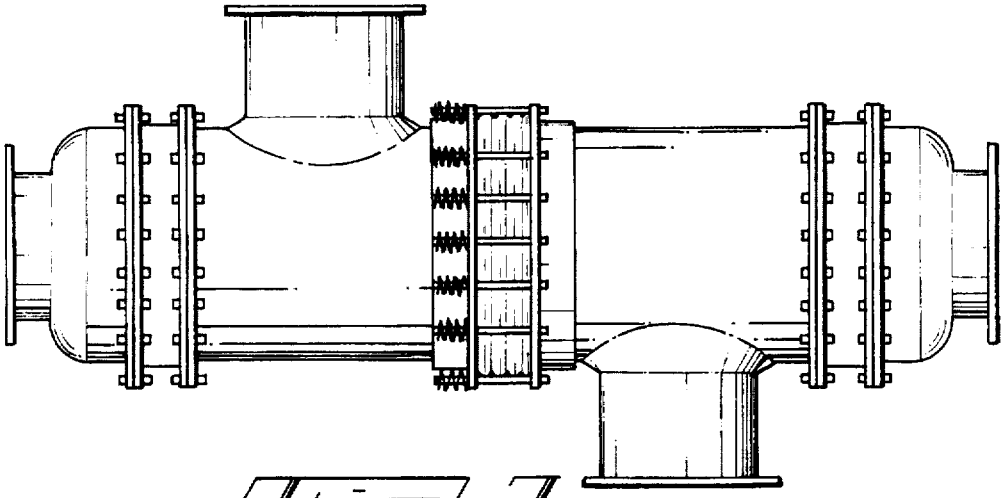
FIG. 7 is a full top view of a heat exchanger of this invention.

One should note the pan assembly 101 generally shown in FIG. 2, and shown in detail in FIG. 5. The pan assembly 101, one will recall is built into the base of the first brick array 4. With reference to FIG. 5, there is shown a portion of the brick array 4 which is fragmented in order to shown an enlarged pan assembly 101.

The pan assembly 101 comprises the nitride bonded silicon carbide brick array 4 which has a back surface 11. For each pan assembly 101, there is a pan opening 12 in the back surface 11 of the base 8. The pan opening 12 has an inside surface at 103. There is located in the pan opening 102 a circular housing 104 with an outside surface 105, and the circular housing 104 is mortared by its outside surface 105 to the inside surface 103 using mortar 106. The purpose of the mortar 106 is that one needs a mortar joint about the periphery of the array 4 that will give tolerance allowance in the dome assembly, and it also provides an easier means to coat the inside of the pan assembly with the ceramic coating 9 if it is a separate piece. The circular housing 104 has a center axis 109 as shown by line E—E on FIG. 5 and it also has a front opening 107 and a back opening 108, it being noted that the openings 107 and 108 have a common center axis with the housing center axis 109.

The front opening 107 is commensurate in size to the channeled openings 7 in the array 4, the back opening 108 being larger in size than the front opening 107. There is a ceramic collar 110 mortared to the near end 87 of ceramic tube 86. The collar 110 is manufactured with controlled dimensions in order to accommodate its use herein. Note that the inside radius of the collar 110 is smaller than the inside dimension of ceramic tube 86. This dissipates part of the thrust from the ceramic tube end 87. The collar 110 has a front surface 111 and a front opening and a back opening 112 and 113 respectively. The front opening 112 has a size smaller than the opening 108 of the circular housing 104 and the back opening 113 is larger than the front opening 112 and is enabled to receive the ceramic tube end 87. The interface between the ceramic tube 86 and the inside of the back opening 113 of the ceramic collar 110 is mortared by mortar 106. There is a crushable ceramifiable fiber gasket or ring 116 located between the collar 110 and the inside surface of the opening 108, which holds the assembly on center during construction. This ring 116 will also permit the tube 86 to twist and swivel in the pan and effectively customize the assembly. Essentially, there are no sealing qualities expected from this ring 116. It will be partially deformed during construction and, after the heat exchanger 1 is fired, it will hold the shape and keep the assembly centered.

It is essential for this invention that there be no leakage between the collar 110 and the dome 24, and between the tube 86 and the collar 110. These surfaces are sealed with a high temperature glaze 117 that is either air or heat setting, which provides tight, slip type surfaces.

The front surface 111 of the collar 110 contains therein a circular channel 114 and situated in the circular channel 114 is a seal ring 115.

With reference to FIG. 6, there is shown an enlarged portion of the baffle wall 89 showing the detail of the tube-to-tube slip seal 118. The baffle wall 89 is a ceramic wall whose main function is to support the distal ends 88 of the ceramic tubes 86. This support is provided by means of an the slip seal 118 and comprises a plurality of openings 122 through the baffle wall 89 which are located such that they align with the distal ends 88 of the ceramic tubes 86. Located within the openings 122 are ceramic slip rings 123, which are not mortared or otherwise fastened into the openings 122. The ceramic tubes 86 are held without bond by the slip rings 123, which are held and supported within the openings 122 such that when the heat exchanger 1 is cool enough, the slip rings 123 are capable of being withdrawn along the outside surface of the ceramic tubes 86 and away from the openings 122, which in turn allows the ceramic tubes 86 to be moved up and out of the heat exchanger 1. It should be noted that once the distal end 88 is cleared from the slip rings 123, then the ceramic tube 86 can be loosened from its seat at the near end 87 and the entire tube 86, with slip ring 123 can be removed from the interior of the heat exchanger 1. This allows for the easy removal and replacement of the ceramic tubes 86.

Figure 9:
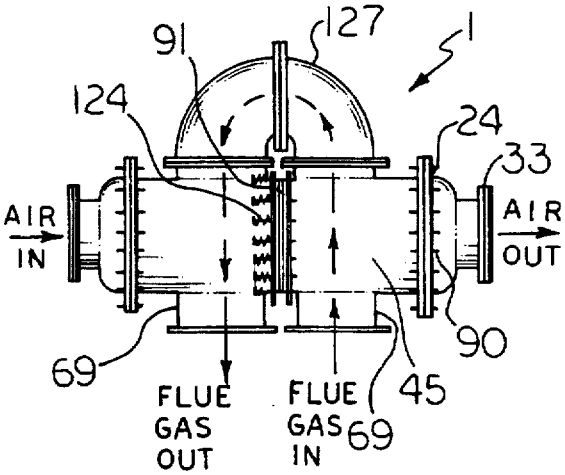
FIG. 9 is a top view of a heat exchanger of this invention having a common duct to allow for multiple passes of flue gas.

FIG. 9 is a top view of a heat exchanger 1 of this invention which is joined by a common duct 127 to provide for multiple passes of the flue gas through the heat exchanger 1. There is also shown a spring 124, a bellows joint 91, a fastener 90, a dome 24, a steel plate 33, a central body 45 and flue ports 69.

Figure 10:
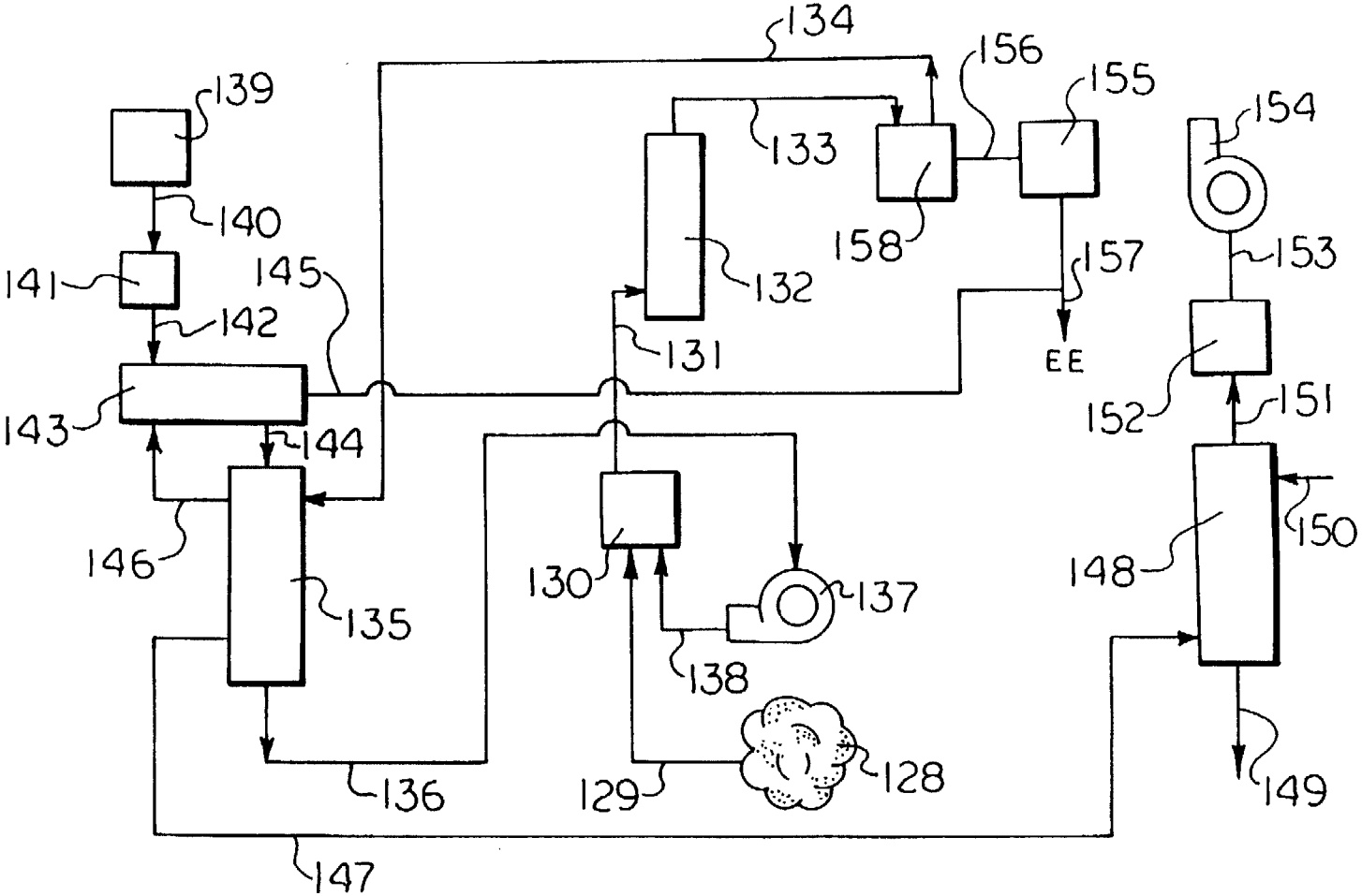
FIG. 10 is a schematic of a system to generate electrical energy from combustible waste.

Turning now to FIG. 10, there is shown a schematic diagram of an improved system for converting combustible waste into electrical energy wherein there is shown a process flow diagram for the generation of power from heat which has been generated from waste or other low grade combustible materials.

Filtered air 142, in approximately the amount required as combustion air, along with the expanded air 134 from the discharge side of the turbine 158 are passed to compressor 143 via 146 and compressed in compressor 143 to around 200 PSIG and then passed to the metal alloy heat exchanger 135 via 144 and exchanged with cold air stream 136 from the ceramic tube heat exchanger of this invention (depicted as box 132 in this diagram). A metal alloy constructed heat exchanger 135 can be used because the discharge side of the ceramic tube exchanged air is at or below the temperature (approximately 1600 degrees Fahrenheit), the point at which metal alloys can operate continuously without severely degrading. It should be noted that air stream 144 is passed via stream 163 to make up combustion air 138. Although it is not required in this invention, the atmospheric air 139 can be passed via 140 to an air filter 141 before it enters the compressor 143. Until the full process is up and running, an outside source of power 159 is required to power the frequency controlled drive 160 for the compressor 143. During the operation of the process, the compressor 143 can be powered from a portion of that power 145 generated in the process.

Combustion air 138 and combustible fuel 129 from combustible waste 128, are fed into the combustion chamber 130. This chamber 130 may be a rotary kiln or a static chamber or the like, depending on the nature of the fuel. The heated gases ("dirty air") 131 from the combustion chamber 130 are indirectly exchanged with the "clean" air 161 (ingoing) and stream 133, (outgoing). The heated "clean" air 133 is expanded in the turbine 158 driving the generator 155, by the coupling 156, thus producing electrical energy 162. This power 157 can be sent into a power grid and/or used elsewhere for other processes.

The "clean" air 134 from the discharge side of the turbine is sent to the alloy metal constructed heat exchanger 135, and then to the air compressor 143, thus continuing the process cycle. The "dirty" flue gas stream 136 is sent to the alloy metal constructed heat exchanger 135 and then via 147 to an air pollution control system where it is neutralized in the dry neutralizing scrubber 148 by the use of lime 150. If it is necessary to clean particulate matter from the air stream 151 at this point, it can be accomplished by the use of a particulate separator 152, and then the discharged air 153 is discharged as clean air to the atmosphere by an induced draft fan, or the like, 154. The spent dry neutralant from lime 150 from the neutralizer 148 can also be mixed with the combustion ash to provide ash treatment. The effluent 149 is passed off for effluent treatment.

What is claimed is:

1. A high temperature high pressure air-to-air sprung dome heat exchanger segment comprising:

(I) a multiple-layered air entry or exit assembly comprising:

(a) a nitride-bonded air entry or exit silicon carbide brick array having an air entry or exit surface, and a base, and an air entry or exit end, said array having essentially a circular configuration, said air entry or exit surface being coated with a dense, low porosity ceramic coating;

said array having a plurality of openings extending from the air entry or exit surface through the base;

said base having a plurality of pan openings therein, each pan opening essentially in alignment with each of the openings in the array:

a first outer brick layer having a plurality of holes therein and a back surface;

a second outer brick layer having a plurality of slots therein and a back surface, said slots and said holes being filled with a light weight, insulating castable material;

a third outer layer which is configured from mullite brick and having a back surface;

(b) a two-layered outer dome having a large center opening therethrough, said outer dome having an inside layer and an outside layer wherein the inside layer is a high temperature type castable insulation and the outside layer has an outside surface and is a low temperature type castable insulation, and wherein both layers have aligned back surfaces laying essentially in the same plane;

(c) a first steel shell, said steel shell having a distal end and a near end, said first steel shell covering essentially the entire outside surface of the two-layered outer dome and conforming essentially to the outside surface of the outside layer of said dome, said first steel shell having a steel plate fixedly attached to and covering the distal end of the first steel shell, said steel plate having a large centered opening therethrough to allow the passage of air into or out of the two-layered outer dome;

(d) a dual-walled steel flange encircling the heat exchanger at the line formed by the near end of the steel shell, said steel flange having a front surface and a back surface, said dual-walled steel flange having an inside edge and an outside edge, said steel flange being fixed to the near end of the steel shell and at the inside edge thereof;

(e) a flat steel bar fixed to the first steel flange front surface and fixed to the outside surface of the first steel shell near the near end thereof to form a brace between the first steel flange and the first steel shell;

(f) a high alloy, metal flashing fixed to the inside surface of the first steel shell and near the near end of the first steel shell, said high alloy metal flashing having a distal edge and said high alloy metal flashing covering the aligned back surfaces of the two-layered outer dome layers and having the distal edge thereof inserted between the first outer brick layer and the second outer brick layer thereof;

(II) a multi-layered central body, said central body having essentially a round configuration wherein there is a first insulating fire brick lining having an outside surface, a second insulating fire brick lining having an outside surface and conforming essentially to the outside surface of the first insulating fire brick lining, and a third insulating fire brick lining having an outside surface and conforming essentially to the outer surface of the second insulating fire brick lining;

a second steel shell having an outside surface covering and conforming essentially to the outside surface of the third insulating fire brick lining, said second steel shell having a near edge and a distal edge;

said second steel shell having a dual-walled second steel flange encircling the heat exchanger segment at the line formed by the near end of the second steel shell, said second steel flange having an inside edge and an outside edge, said second steel flange being fixed to the near end of the second steel shell and at the inside edge thereof;

the first steel flange and the second steel flange being fixed together near their respective outside edges by a flat steel cover having an inside surface such that the flat steel cover, the first steel flange, the second steel flange and the third outer layer of the air entry or exit assembly form a tunnel encircling the heat exchanger segment;

said inside surface of the steel cover being covered with a ceramic fiber matting and said tunnel being filled with castable mullite;

the back surfaces of the first fire brick layer, the second insulating fire brick layer and the third insulating fire brick layer being layered with a ceramic fiberboard, the fiberboard having a back surface, there being a ceramic fiber matting layered against the back surface of the ceramic fiber board over the area opposite the third outer layer of mullite, said ceramic fiber matting being configured such that it also covers any exposed mullite in the tunnel;

a second flat steel bar fixed to the second steel flange back surface and fixed to the outside surface of the second steel shell near the near edge thereof to form a second brace between the second steel flange and the second steel shell;

there being a flue gas port for entry or exit of flue gas, said port being configured such that entry or exit of flue gas to the heat exchanger segment is essentially perpendicular to the flow of air through the heat exchanger segment, said port being configured such that it is a round configuration wherein there is a first flue insulating fire brick lining having an outside surface, a second flue insulating fire brick lining having an outside surface and conforming essentially to the outside surface of the first flue insulating fire brick lining, and a third flue insulating fire brick lining having an outside surface and conforming essentially to the second flue insulating fire brick lining;

a third steel shell, said steel shell having a distal end and a near end, said third steel shell covering essentially the entire outside surface of the flue gas port and conforming essentially to the outside surface of the third flue insulating fire brick lining, said third steel shell having a second steel plate fixedly attached to and covering the distal end of the third steel shell, said second steel plate having a large centered opening therethrough to allow the passage of flue gas into and out of the central body thereof;

the second steel shell having fixed on and encircling the outside surface, near the distal end thereof, an L-shaped steel bar having a vertical wall and a horizontal wall, said vertical wall having an opening centered therethrough;

said second steel shell having fixed on its inside surface near the distal end thereof, a flat metal plate, which flat metal plate conforms to the inside of the second steel sheet;

a plurality of ceramic tubes having near ends and distal ends, each ceramic tube being aligned at their near ends and inserted in a pan opening in the silicon brick array;

said ceramic tubes being supported on their distal ends by a baffle wall.

2. A heat exchanger as claimed in claim 1 wherein there is additionally present a common duct which allows multiple passes of gas.

3. A high temperature high pressure air-to-air sprung dome heat exchanger comprising in combination:

(I) two heat exhanger segments of claim 1 aligned end-to-end at their respective ends such that the ceramic tubes contained in each of them align at the ceramic tube distal ends and are supported by a common baffle wall;

(II) a bellows expansion joint affixed to the base of the L-shaped steel bars essentially at the intersection of the vertical and horizontal walls;

(III) a plurality of fasteners spaced along the L-shaped steel bars, and in alignment with the respective holes centered in the vertical walls thereof, each of said fasteners having a near end and a distal end, each of said fasteners being adjustable by an adjusting means on their near ends and each of said fasteners being equipped on the distal end with a compressible compression spring which spring is located between a second adjustment means located on the distal end, and the L-shaped steel bar;

said fasteners fastening and holding the heat exchanger segments to each other and, wherein the second flat metal plate conforming to the inside of one of the second steel sheets is not fixed to said steel sheet on one of its edges and, wherein all abutting insulation fire brick surfaces have a ceramic fiber matting between them.

4. A heat exhanger as claimed in claim 3 wherein the two-layered outer dome (b) is retained with alloy steel Y-shaped anchors fixed to the first steel shell.

5. A pan assembly for use in a heat exchanger, said pan assembly comprising in combination:

(A) a nitride bonded silicon carbide brick array having an air entry or exit surface, and a base having a back surface;

said array having a plurality of pan openings through the back surface of the base, said pan openings having an inside surface;

each said pan opening having a circular housing with an outside surface, said housing mortared at its outside surface to the inside surface of the pan opening, said housing having a center axis, a front opening, and a back opening, wherein the openings have a common center axis with the housing center axis, the front opening in said housing being commensurate in size to the openings in the array, the back opening being larger than the front opening;

there being a crushable, friable ceramic fiber ring interfacing with the inside surface of the housing and, (B) a ceramic tube having mortared on one end thereof a ceramic collar, said collar having a front surface and a front opening and a back opening, said front opening having a size smaller than the opening of the circular housing and the back opening being larger than the front opening and enabled to receive the ceramic tube end, the interface between the ceramic tube end and the inside of the back opening of the ceramic collar being mortar, the front surface containing therein a circular channel, said channel containing a seal ring.

6. A pan assembly as claimed in claim 5 wherein the seal ring is a ceramic seal ring.

7. A pan assembly as claimed in claim 5 wherein the seal ring is a high alloy metal seal ring.

8. A high temperature high pressure air-to-air sprung dome heat exchanger comprising in combination two heat exhanger segments each said segment comprising:

(I) a multiple-layered air entry or exit assembly comprising:

(a) a nitride-bonded air entry or exit silicon carbide brick array having an air entry or exit surface, and a base, and an air entry or exit end, said array having essentially a circular configuration, said air entry or exit surface being coated with a dense, low porosity ceramic coating;

said array having a plurality of openings extending from the air entry or exit surface through the base;

said base having a plurality of pan openings therein, each pan opening essentially in alignment with each of the openings in the array:

a first outer brick layer having a plurality of holes therein and a back surface;

a second outer brick layer having a plurality of slots therein and a back surface, said slots and said holes being filled with a light weight, insulating castable material;

a third outer layer which is configured from mullite brick and having a back surface;

(b) a two-layered outer dome having a large center opening therethrough, said outer dome having an inside layer and an outside layer wherein the inside layer is a high temperature type castable insulation and the outside layer has an outside surface and is a low temperature type castable insulation, and wherein both layers have aligned back surfaces laying essentially in the same plane;

(c) a first steel shell, said steel shell having a distal end and a near end, said first steel shell covering essentially the entire outside surface of the two-layered outer dome and conforming essentially to the outside surface of the outside layer of said dome, said first steel shell having a steel plate fixedly attached to and covering the distal end of the first steel shell, said steel plate having a large centered opening therethrough to allow the passage of air into or out of the two-layered outer dome;

(d) a dual-walled steel flange encircling the heat exchanger at the line formed by the near end of the steel shell, said steel flange having a front surface and a back surface, said dual-walled steel flange having an inside edge and an outside edge, said steel flange being fixed to the near end of the steel shell and at the inside edge thereof;

(e) a flat steel bar fixed to the first steel flange front surface and fixed to the outside surface of the first steel shell near the near end thereof to form a brace between the first steel flange and the first steel shell;

(f) a high alloy, metal flashing fixed to the inside surface of the first steel shell and near the near end of the first steel shell, said high alloy metal flashing having a distal edge and said high alloy metal flashing covering the aligned back surfaces of the two-layered outer dome layers and having the distal edge thereof inserted between the first outer brick layer and the second outer brick layer thereof;

(II) a multi-layered central body, said central body having essentially a round configuration wherein there is a first insulating fire brick lining having an outside surface, a second insulating fire brick lining having an outside surface and conforming essentially to the outside surface of the first insulating fire brick lining, and a third insulating fire brick lining having an outside surface and conforming essentially to the outer surface of the second insulating fire brick lining;

a second steel shell having an outside surface covering and conforming essentially to the outside surface of the third insulating fire brick lining, said second steel shell having a near edge and a distal edge;

said second steel shell having a dual-walled second steel flange encircling the heat exchanger segment at the line formed by the near end of the second steel shell, said second steel flange having an inside edge and an outside edge, said second steel flange being fixed to the near end of the second steel shell and at the inside edge thereof;

the first steel flange and the second steel flange being fixed together near their respective outside edges by a flat steel cover having an inside surface such that the flat steel cover, the first steel flange, the second steel flange and the third outer layer of the air entry or exit assembly form a tunnel encircling the heat exchanger segment;

said inside surface of the steel cover being covered with a ceramic fiber matting and said tunnel being filled with castable mullite;

the back surfaces of the first fire brick layer, the second insulating fire brick layer and the third insulating fire brick layer being layered with a ceramic fiberboard, the fiberboard having a back surface, there being a ceramic fiber matting layered against the back surface of the ceramic fiber board over the area opposite the third outer layer of mullite, said ceramic fiber matting being configured such that it also covers any exposed mullite in the tunnel;

a second flat steel bar fixed to the second steel flange back surface and fixed to the outside surface of the second steel shell near the near edge thereof to form a second brace between the second steel flange and the second steel shell;

there being a flue gas port for entry or exit of flue gas, said port being configured such that entry or exit of flue gas to the heat exchanger segment is essentially perpendicular to the flow of air through the heat exchanger segment, said port being configured such that it is a round configuration wherein there is a first flue insulating fire brick lining having an outside surface, a second flue insulating fire brick lining having an outside surface and conforming essentially to the outside surface of the first flue insulating fire brick lining, and a third flue insulating fire brick lining having an outside surface and conforming essentially to the second flue insulating fire brick lining;

a third steel shell, said steel shell having a distal end and a near end, said third steel shell covering essentially the entire outside surface of the flue gas port and conforming essentially to the outside surface of the third flue insulating fire brick lining, said third steel shell having a second steel plate fixedly attached to and covering the distal end of the third steel shell, said second steel plate having a large centered opening therethrough to allow the passage of flue gas into and out of the central body thereof;

the second steel shell having fixed on and encircling the outside surface, near the distal end thereof, an L-shaped steel bar having a vertical wall and a horizontal wall, said vertical wall having an opening centered therethrough;

said second steel shell having fixed on its inside surface near the distal end thereof, a flat metal plate, which flat metal plate conforms to the inside of the second steel sheet;

a plurality of ceramic tubes having near ends and distal ends, each ceramic tube being aligned at their near ends and inserted in a pan opening in the silicon brick array, the heat exchanger segments being aligned end-to-end at their respective ends such that the ceramic tubes contained in each of them align at the ceramic tube distal ends and are supported by a common baffle wall;

(III) a bellows expansion joint affixed to the base of the L-shaped steel bars essentially at the intersection of the vertical and horizontal walls;

(IV) a plurality of fasteners spaced along the L-shaped steel bars, and in alignment with the respective holes centered in the vertical walls thereof, each of said fasteners having a near end and a distal end, each of said fasteners being adjustable by an adjusting means on their near ends and each of said fasteners being equipped on the distal end with a compressible compression spring which spring is located between a second adjustment means located on the distal end, and the L-shaped steel bar;

said fasteners fastening and holding the heat exchanger segments to each other and, wherein the second flat metal plate conforming to the inside of one of the second steel sheets is not fixed to said steel sheet on one of its edges and, wherein all abutting insulation fire brick surfaces have a ceramic fiber matting between them.

9. A heat exchanger as claimed in claim 8 wherein there is additionally present a common duct which allows multiple passes of gas.

10. A heat exchanger as claimed in claim 8 wherein there is additionally present more than one common duct to allow multiple passes of gas and air.

11. An improved system for generating electrical energy from combustible waste, the system comprising in combination at least:

(A) a high pressure clean air supply for supplying air to an alloy metal heat exchanger operably joined to the high pressure clean air supply;

(B) at least one alloy metal heat exchanger;

(C) a combustible waste delivery means joined with (D) a combustion chamber for combustible waste;

(E) at least one high temperature ceramic heat exchanger as claimed in claim 7, which supplies heat to (F) an expansion turbine for accepting heat from a high temperature ceramic heat exchanger;

(G) an electrical generator driven by the output of the expansion turbine;

(H) an acid neutralizing scrubber, for scrubbing any residue from the combustion chamber (D).

12. A system as claimed in claim 11 wherein there is additionally present an air filter to filter atmospheric air prior to delivery of the air to the air compressor.

13. A system as claimed in claim 12 wherein there is additionally present a frequency increaser for the increasing the frequency of the power generated by the generator.

14. A system as claimed in claim 13 wherein there is additionally present a particulate separator for separating any particulates from the air stream passing from the neutralizing scrubber to the atmosphere.

* * * * *